US007965182B2

(12) United States Patent
Becker

(10) Patent No.: US 7,965,182 B2
(45) Date of Patent: Jun. 21, 2011

(54) APPARATUS AND METHOD FOR PROVIDING A FAILSAFE-ENABLED WIRELESS DEVICE

(75) Inventor: Jeffrey M. Becker, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 700 days.

(21) Appl. No.: 12/028,172

(22) Filed: Feb. 8, 2008

(65) Prior Publication Data

US 2009/0201150 A1 Aug. 13, 2009

(51) Int. Cl.
*G08B 1/08* (2006.01)

(52) U.S. Cl. ..... 340/539.21; 340/539.23; 340/507; 340/606; 340/611; 340/618

(58) Field of Classification Search ..... 340/539.21, 340/539.23, 539.1, 507, 521, 540, 541, 552, 340/589, 606, 611, 614, 618, 626
See application file for complete search history.

(56) References Cited

U.S. PATENT DOCUMENTS

| | | | | |
|---|---|---|---|---|
| 5,406,842 | A | 4/1995 | Locke | |
| 5,442,359 | A | 8/1995 | Rubin | |
| 5,774,089 | A | 6/1998 | Bamler et al. | |
| 6,629,458 | B1 | 10/2003 | Westerling et al. | |
| 7,605,697 | B2 * | 10/2009 | D'Agostino et al. | 340/539.21 |
| 7,764,171 | B2 * | 7/2010 | Cheng et al. | 340/539.26 |
| 2003/0167839 | A1 | 9/2003 | Burger et al. | |
| 2004/0196177 | A1 | 10/2004 | Billington et al. | |
| 2005/0190098 | A1 | 9/2005 | Bridgelall et al. | |

FOREIGN PATENT DOCUMENTS

| | | | |
|---|---|---|---|
| DE | 100 40 180 | A1 | 4/2002 |
| NL | 1032192 | | 7/2006 |
| WO | WO 2004/053521 | A1 | 6/2004 |
| WO | WO 2007/053007 | A1 | 5/2007 |
| WO | WO 2007/111498 | A2 | 10/2007 |

OTHER PUBLICATIONS

Larry Taylor, "Wireless Tank Overfill Protection", 9th Annual International Conference on Aboveground Storage Tanks, May 23-25, 2006, 42 pages.
"Servo Gauge 854ATG", Product Sheet, Enraf, 4 pages.
"Level sensor", http://en.wikipedia.org/wiki/Level_sensor, Aug. 2, 2008, 8 pages.
"HERMetic Sensor Ultra", Honeywell Enraf, 4 pages.
International Standard, Petroleum and liquid petroleum products-Measurement of level and temperature in storage tanks by automatic methods, Part 3: Measurement of level in pressurized storage tanks (non-refrigerated), 1st Edition, Nov. 15, 2002, 21 pages.
Bin Sai, "Method and Apparatus for Real-Time Calibration of a Liquid Storage Tank Level Gauge", U.S. Appl. No. 12/119,957, filed May 13, 2008.

* cited by examiner

*Primary Examiner* — Hung T. Nguyen
(74) *Attorney, Agent, or Firm* — Munck Carter, LLP

(57) ABSTRACT

A method for operating a failsafe-enabled wireless device is provided that includes monitoring a signal quality for a wireless signal between a failsafe-enabled wireless device and a controller. A determination is made regarding whether the signal quality is poor. A failsafe procedure is initiated when the signal quality is poor.

20 Claims, 3 Drawing Sheets

APPARATUS AND METHOD FOR PROVIDING A FAILSAFE-ENABLED WIRELESS DEVICE

TECHNICAL FIELD

This disclosure relates generally to process control systems and more specifically to an apparatus and method for providing a failsafe-enabled wireless device.

BACKGROUND

Processing facilities, such as manufacturing plants, chemical plants, crude oil refineries, ore processing plants and the like, are often managed using process control systems. Among other operations, process control systems typically manage the use of motors, valves, and other industrial equipment in the processing facilities.

In conventional process control systems, controllers are often used to control one or more processes that are occurring or being implemented. The controllers may, for example, monitor the operation of the industrial equipment, provide control signals to the industrial equipment, and generate alarms when malfunctions are detected. Conventional process control systems are often responsible for monitoring and controlling numerous process variables, which generally represent characteristics of the process being monitored and controlled. Human operators are often responsible for monitoring and adjusting the controllers in the process control systems, thereby helping to ensure that the controllers are accurately modeling and controlling the processes.

Field instruments, such as temperature sensors and the like, provide useful information about the process system that may be used by the process control system. If these field instruments were wireless, the cost of deployment as compared with wired alternatives would be dramatically reduced. However, because of the possibility of losing the wireless signal and, as a result, the corresponding information provided to the process control system, typical process systems implement wireless field instruments only in areas where there would be no potential harm should the wireless signal be lost. Because of this, the number of wireless field instruments that are typically deployed in a process system is limited, reducing the potential cost-savings associated with wireless technology.

SUMMARY

This disclosure provides an apparatus and method for providing a failsafe-enabled wireless device.

In a first embodiment, a method includes monitoring a signal quality for a wireless signal between a failsafe-enabled wireless device and a controller. A determination is made regarding whether the signal quality is poor. A failsafe procedure is initiated when the signal quality is poor.

In particular embodiments, the method further includes detecting at least one hazard indicator, and initiating the failsafe procedure includes initiating the failsafe procedure when both the signal quality is poor and the at least one hazard indicator is detected.

In other particular embodiments, the method further includes receiving hazard indicator information from at least one wireless device in communication with the failsafe-enabled wireless device, and initiating the failsafe procedure includes initiating the failsafe procedure when both the signal quality is poor and the hazard indicator information is received from the at least one wireless device.

In yet other particular embodiments, initiating the failsafe procedure when the signal quality is poor includes generating a failsafe control signal and sending the failsafe control signal to a responding device.

In other particular embodiments, determining whether the signal quality is poor includes comparing the signal quality to a predetermined threshold.

In still other particular embodiments, determining whether the signal quality is poor includes determining whether the signal quality has fallen by a specified percentage.

In other particular embodiments, the method further includes generating a failsafe control signal for the failsafe-enabled wireless device and implementing the failsafe procedure within the failsafe-enabled wireless device.

In a second embodiment, an apparatus includes a failsafe control system for a failsafe-enabled wireless device. The failsafe control system is operable to monitor a signal quality for a wireless signal between the failsafe-enabled wireless device and a controller, to determine whether the signal quality is poor, and to initiate a failsafe procedure when the signal quality is poor.

In particular embodiments, the failsafe control system comprises a wired loop control.

In a third embodiment, a computer program is embodied on a computer readable medium. The computer program includes computer readable program code for monitoring a signal quality for a wireless signal between a failsafe-enabled wireless device and a control room, determining whether the signal quality is poor, and initiating a failsafe procedure when the signal quality is poor.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
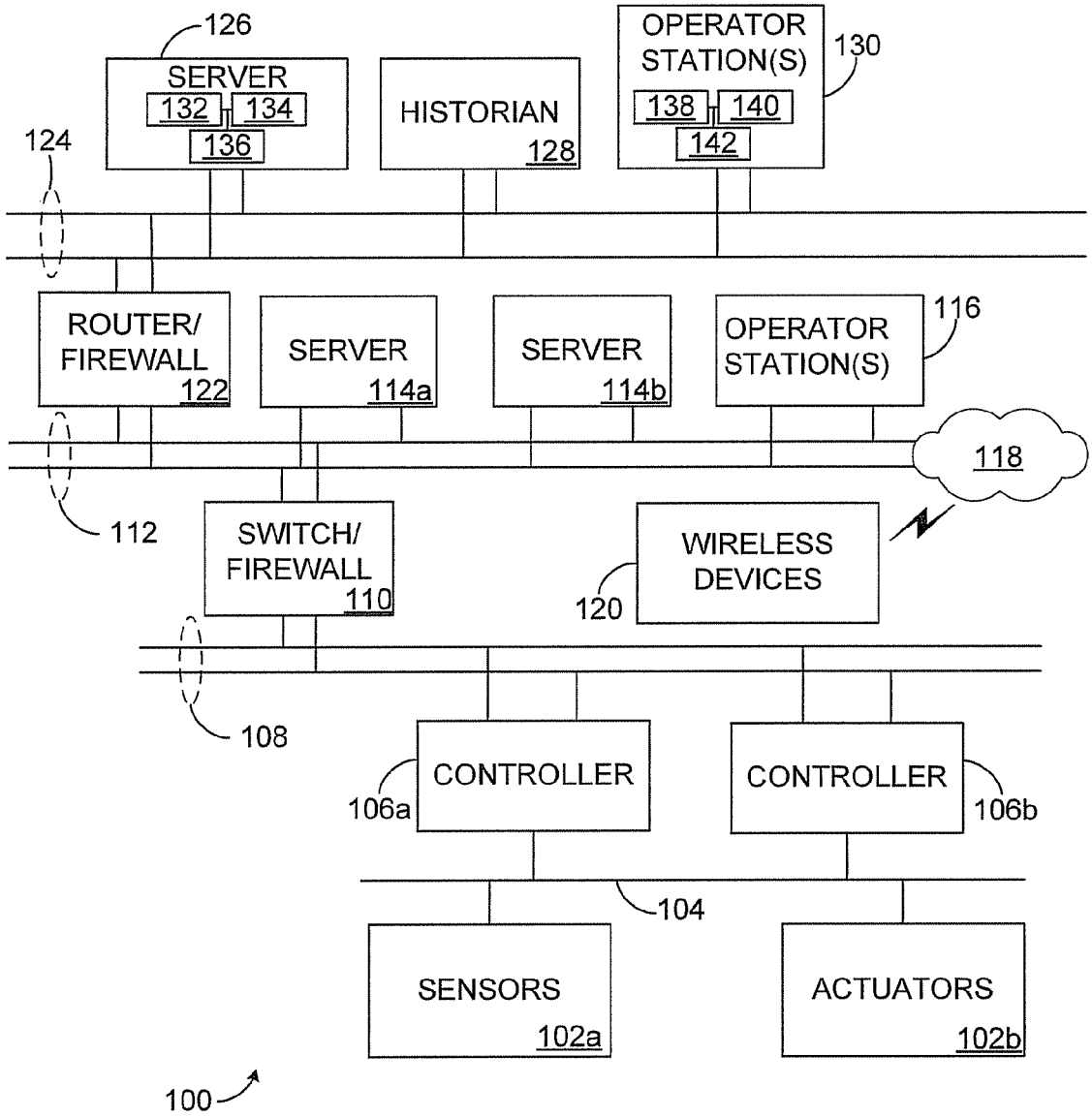
FIG. 1 illustrates a process control system including a failsafe-enabled wireless device according to one embodiment of this disclosure.
Figure 2:
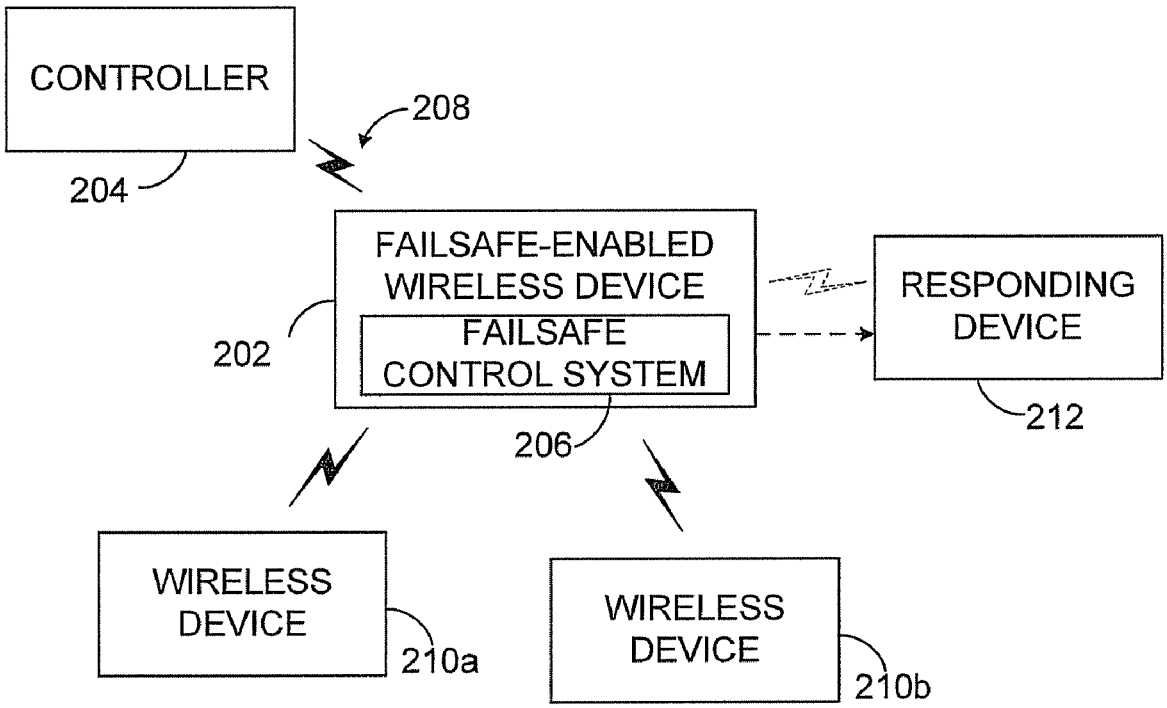
FIG. 2 illustrates a failsafe-enabled wireless device according to one embodiment of this disclosure.
Figure 3:
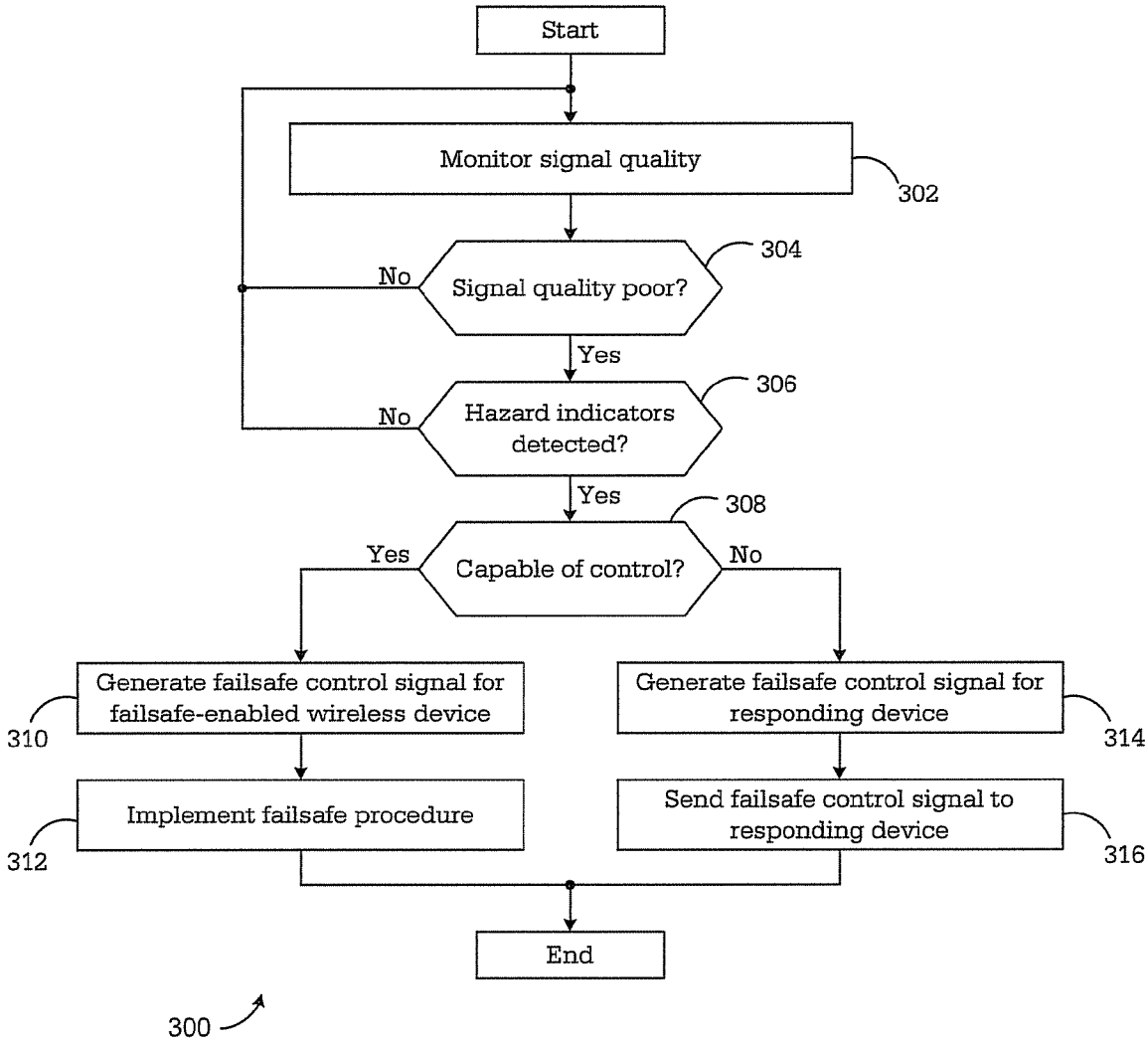
FIG. 3 illustrates a method for operating the failsafe-enabled wireless device of FIG. 2 according to one embodiment of this disclosure.

FIGS. 1 through 3, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

FIG. 1 illustrates a process control system 100 according to one embodiment of this disclosure. The embodiment of the process control system 100 shown in FIG. 1 is for illustration only. Other embodiments of the process control system 100 may be used without departing from the scope of this disclosure.

In this embodiment, the process control system 100 includes various components that facilitate production or processing of at least one product or other material, such as one or more sensors 102*a* and one or more actuators 102*b*. The sensors 102*a* and actuators 102*b* represent components in a process system that may perform any of a wide variety of functions. For example, the sensors 102*a* may measure a wide variety of characteristics in a process system, such as temperature, pressure, or flow rate. Also, the actuators 102*b* may alter a wide variety of characteristics in the process system and may represent components such as heaters, motors, or valves. The sensors 102*a* and actuators 102*b* may represent any other or additional components in any suitable process system. Each of the sensors 102*a* includes any suitable structure for measuring one or more characteristics in a process system. Each of the actuators 102*b* includes any suitable structure for operating on or affecting conditions in a process system. Also, a process system may generally represent any system or portion thereof configured to process one or more products or other materials in some manner.

At least one network 104 is coupled to the sensors 102*a* and actuators 102*b*. The network 104 facilitates interaction with the sensors 102*a* and actuators 102*b*. For example, the network 104 may transport measurement data from the sensors 102*a* and provide control signals to the actuators 102*b*. The network 104 may represent any suitable network or combination of networks. As particular examples, the network 104 may represent an Ethernet network, an electrical signal network (such as a HART or FOUNDATION FIELDBUS network), a pneumatic control signal network, or any other or additional type(s) of network(s).

One or more controllers 106*a*-106*b* may be coupled to the network 104. The controllers 106*a*-106*b* may, among other things, use the measurements from the sensors 102*a* to control the operation of the actuators 102*b*. For example, the controllers 106*a*-106*b* may receive measurement data from the sensors 102*a* and use the measurement data to generate control signals for the actuators 102*b*. Each of the controllers 106*a*-106*b* includes any hardware, software, firmware, or combination thereof for interacting with the sensors 102*a* and controlling the actuators 102*b*. The controllers 106*a*-106*b* may, for example, represent multivariable predictive control (MPC) controllers or other types of controllers that implement control logic (such as logic associating sensor measurement data to actuator control signals). Each of the controllers 106*a*-106*b* may, for example, represent a computing device running a MICROSOFT WINDOWS operating system.

One or more networks 108 may be coupled to the controllers 106*a*-106*b*. The networks 108 facilitate interaction with the controllers 106*a*-106*b*, such as by transporting data to and from the controllers 106*a*-106*b*. The networks 108 may represent any suitable networks or combination of networks. As particular examples, the networks 108 may represent a pair of Ethernet networks or a redundant pair of Ethernet networks, such as a FAULT TOLERANT ETHERNET (FTE) network from HONEYWELL INTERNATIONAL INC.

At least one switch/firewall 110 couples the networks 108 to networks 112. The switch/firewall 110 may transport traffic from one network to another. The switch/firewall 110 may also block traffic on one network from reaching another network. The switch/firewall 110 includes any suitable structure for providing communication between networks, such as a HONEYWELL CONTROL FIREWALL (CF9) device. The networks 112 may represent any suitable networks, such as a pair of Ethernet networks or an FTE network.

One or more servers 114*a*-114*b* may be coupled to the networks 112. The servers 114*a*-114*b* perform various functions to support the operation and control of the controllers 106*a*-106*b*, sensors 102*a*, and actuators 102*b*. For example, the servers 114*a*-114*b* may log information collected or generated by the controllers 106*a*-106*b*, such as measurement data from the sensors 102*a* or control signals for the actuators 102*b*. The servers 114*a*-114*b* may also execute applications that control the operation of the controllers 106*a*-106*b*, thereby controlling the operation of the actuators 102*b*. In addition, the servers 114*a*-114*b* may provide secure access to the controllers 106*a*-106*b*. Each of the servers 114*a*-114*b* includes any hardware, software, firmware, or combination thereof for providing access to, control of, or operations related to the controllers 106*a*-106*b*. Each of the servers 114*a*-114*b* may, for example, represent a computing device running a MICROSOFT WINDOWS operating system.

One or more operator stations 116 may be coupled to the networks 112. The operator stations 116 represent computing or communication devices providing user access to the servers 114*a*-114*b*, which may then provide user access to the controllers 106*a*-106*b* (and possibly the sensors 102*a* and actuators 102*b*). As particular examples, the operator stations 116 may allow users to review the operational history of the sensors 102*a* and actuators 102*b* using information collected by the controllers 106*a*-106*b* and/or the servers 114*a*-114*b*. The operator stations 116 may also allow the users to adjust the operation of the sensors 102*a*, actuators 102*b*, controllers 106*a*-106*b*, or servers 114*a*-114*b*. In addition, the operator stations 116 may receive and display warnings or other messages or displays generated by the controllers 106*a*-106*b* or the servers 114*a*-114*b*. Each of the operator stations 116 includes any hardware, software, firmware, or combination thereof for supporting user access and control of the system 100. Each of the operator stations 116 may, for example, represent a computing device running a MICROSOFT WINDOWS operating system.

The system 100 may also include a wireless network 118, which can be used to facilitate communication with one or more wireless devices 120. The wireless network 118 may use any suitable technology to communicate, such as radio frequency (RF) signals. Also, the wireless devices 120 may represent devices that perform any suitable functions. The wireless devices 120 may, for example, represent wireless sensors, wireless actuators, and remote or portable operator stations or other user devices. The network 118 may be coupled to networks 112 or otherwise suitably coupled to the system 100 in order to provide communication between the wireless devices 120 and other components within the system 100.

At least one router/firewall 122 couples the networks 112 to networks 124. The router/firewall 122 includes any suitable structure for providing communication between networks, such as a secure router or combination router/firewall. The networks 124 may represent any suitable networks, such as a pair of Ethernet networks or an FTE network.

The system 100 may also include at least one additional server 126 coupled to the networks 124. The server 126 executes various applications to control the overall operation of the system 100. For example, the system 100 may be used in a processing plant or other facility, and the server 126 may execute applications used to control the plant or other facility. As particular examples, the server 126 may execute applications such as enterprise resource planning (ERP), manufacturing execution system (MES), or any other or additional plant or process control applications. The server 126 includes any hardware, software, firmware, or combination thereof for controlling the overall operation of the system 100.

A historian 128 may also be coupled to the networks 124. The historian 128 generally collects information associated with the operation of the system 100. For example, the historian 128 may collect measurement data associated with the operation of the sensors 102*a*. The historian 128 may also collect control data provided to the actuators 102*b*. The historian 128 may collect any other or additional information associated with the process control system 100. The historian 128 includes any suitable storage and retrieval device or devices, such as a database.

One or more operator stations 130 may also be coupled to the networks 124. The operator stations 130 represent computing or communication devices providing, for example, user access to the servers 114*a*-114*b*, 126 and the historian 128. Each of the operator stations 130 includes any hardware, software, firmware, or combination thereof for supporting user access and control of the system 100. Each of the operator stations 130 may, for example, represent a computing device running a MICROSOFT WINDOWS operating system.

In particular embodiments, the various servers and operator stations may represent computing devices. For example, each of the servers 114*a*-114*b*, 126 may include one or more processors 132 and one or more memories 134 for storing instructions and data used, generated, or collected by the processor(s) 132. Each of the servers 114*a*-114*b*, 126 may also include at least one network interface 136, such as one or more Ethernet interfaces. Also, each of the operator stations 116, 130 may include one or more processors 138 and one or more memories 140 for storing instructions and data used, generated, or collected by the processor(s) 138. Each of the operator stations 116, 130 may also include at least one network interface 142, such as one or more Ethernet interfaces.

In one aspect of operation, at least one failsafe-enabled wireless device can be implemented in the process system to allow a failsafe procedure to be implemented in the event of a wireless signal loss for the failsafe-enabled wireless device. For example, at least one of the wireless devices 120 may comprise a failsafe-enabled wireless device that is operable to initiate a failsafe procedure when a signal quality for the wireless device is determined to be poor. For some embodiments, the failsafe-enabled wireless device may also initiate the failsafe procedure based on hazard indicators. For example, the failsafe procedure may be initiated when a parameter measured or sensed by the failsafe-enabled wireless device indicates a potential hazard, in addition to the signal quality being poor.

Although FIG. 1 illustrates one example of a process control system 100, various changes may be made to FIG. 1. For example, a control system may include any number of sensors, actuators, controllers, servers, operator stations, and networks. Also, the makeup and arrangement of the process control system 100 in FIG. 1 is for illustration only. Components may be added, omitted, combined, or placed in any other suitable configuration according to particular needs. In addition, FIG. 1 illustrates one operational environment in which a failsafe-enabled wireless device may be used. This functionality may be used in any other suitable device or system.

FIG. 2 illustrates a failsafe-enabled wireless device 202 according to one embodiment of this disclosure. The failsafe-enabled wireless device 202 may correspond to one of the wireless devices 120 of the process control system 100. However, it will be understood that the failsafe-enabled wireless device 202 may be implemented in any suitable system.

The failsafe-enabled wireless device 202 is operable to communicate wirelessly with a controller 204. For one embodiment, the controller 204 may represent a control room that includes one or more components of the process control system 100 that are operable to provide control over a process system. However, as described in more detail below, it will be understood that the controller 204 may represent any other suitable component based on the environment in which the failsafe-enabled wireless device 202 is implemented. The failsafe-enabled wireless device 202 may be located remotely from the controller 204 and communicate over any suitable wireless network (not illustrated in FIG. 2) or other wireless connection with the controller 204.

The failsafe-enabled wireless device 202 is operable to measure and/or sense information related to the system in which the failsafe-enabled wireless device 202 is implemented and to transmit that information to the controller 204. The controller 204 is then operable to act on that information. For example, for the embodiment in which the controller 204 represents a control room of the process control system 100, the controller 204 is operable to control components within the process control system 100 and/or the process system itself in order to make any adjustments indicated by the information received from the failsafe-enabled wireless device 202.

For the illustrated embodiment, the failsafe-enabled wireless device 202 comprises a failsafe control system 206. For other embodiments, the failsafe-enabled wireless device 202 may be coupled to the failsafe control system 206. As used herein, a failsafe-enabled wireless device 202 is thus a wireless device in communication with a failsafe control system 206.

The failsafe control system 206 is operable to monitor a signal quality for a wireless signal 208 between the failsafe-enabled wireless device 202 and the controller 204. If the quality of that signal 208 becomes poor such that the controller 204 is no longer able to receive information from the failsafe-enabled wireless device 202, the failsafe control system 206 is also operable to initiate a failsafe procedure to prevent potentially hazardous conditions from developing due to the absence of the information at the controller 204.

The failsafe control system 206 is operable to determine whether the signal quality is poor by comparing the signal quality to a predetermined threshold, by determining whether the signal quality has fallen by a specified percentage, or in any other suitable manner. The quality may be measured based on packet/data loss, number of retransmissions, signal strength on the transmit and/or receive sides, and/or any other suitable signal quality indicators.

As illustrated in FIG. 2, the failsafe-enabled wireless device 202 may also be operable to communicate wirelessly with other wireless devices 210*a*-*b*. For some embodiments, the wireless devices 210*a*-*b* may correspond to at least some of the wireless devices 120. In addition, each of the wireless devices 210*a* and 210*b* may or may not also be a failsafe-enabled wireless device.

As described above in connection with FIG. 1, the failsafe control system 206 may be operable to initiate the failsafe procedure based on hazard indicators, as well as a poor-quality signal 208. For example, the failsafe control system 206 may initiate the failsafe procedure when both the signal quality of the signal 208 becomes poor and at least one parameter measured or sensed by the failsafe-enabled wireless device 202 indicates a potential hazard. In addition, for some embodiments, the failsafe control system 206 may initiate the failsafe procedure based on the signal quality of the signal 208 and based on hazard indicator information received from another wireless device 210 within the system that indicates a potential hazard. For other embodiments, the failsafe control system 206 may initiate the failsafe procedure based on (i) the signal quality of the signal 208, (ii) at least one hazard indicator determined by the failsafe control system 206 based on a parameter measured or sensed by the failsafe-enabled wireless device 202, and (iii) hazard indicator information received from another wireless device 210 within the system.

The failsafe control system 206 may comprise any suitable configuration. For example, the failsafe control system 206 may comprise a wired loop control. For a particular example of this embodiment, a failsafe-enabled wireless device 202 that is a temperature transmitter may include a failsafe control system 206 that comprises a wired loop control that closes a contact when the signal quality 208 is poor, thereby turning off a valve to prevent temperature-related hazards. Additional hazard indicators that may be considered by this particular failsafe control system 206 may include the temperature exceeding a predetermined threshold, deviating from a last-reported temperature by a specified percentage, and the like.

The failsafe-enabled wireless device 202 may operate according to multiple embodiments when the failsafe procedure has been initiated. For example, for a first embodiment, the failsafe-enabled wireless device 202 is incapable of actual control. For a second embodiment, the failsafe-enabled wireless device 202 is capable of actual control. In particular, for the first embodiment, the failsafe-enabled wireless device 202 may comprise a sensor, such as one of the sensors 102*a*, while for the second embodiment, the failsafe-enabled wireless device 202 may comprise an actuator, such as one of the actuators 102*b*.

Thus, for the first embodiment, the failsafe control system 206 is operable initiate the failsafe procedure by generating a failsafe control signal and sending (or prompting the failsafe-enabled wireless device 202 to send) the failsafe control signal to a responding device 212. The responding device 212 may comprise any suitable device that is capable of taking action, such as turning a pump on or off, sounding an alarm, locking or unlocking a door, or the like, in response to a failsafe control signal generated by the failsafe control system 206. The responding device 212 may correspond to one of the actuators 102*b* of the process control system 100. However, it will be understood that the responding device 212 may be implemented in any suitable system. The responding device 212 is then operable to actually implement the failsafe procedure. For example, if the responding device 212 comprises a valve, the responding device 212 may implement the failsafe procedure by turning off the valve. As illustrated in FIG. 2, the failsafe control signal may be sent from the failsafe-enabled wireless device 202 to the responding device 212 either wirelessly or over a wired link, depending on the particular implementation of the system.

For the second embodiment, the failsafe control system 206 may generate a failsafe control signal for the failsafe-enabled wireless device 202 that prompts the device 202 to implement the failsafe procedure. The failsafe-enabled wireless device 202 is then operable to implement the failsafe procedure itself. For example, if the failsafe-enabled wireless device 202 comprises a valve, the failsafe-enabled wireless device 202 may implement the failsafe procedure by turning off the valve. For this embodiment, the failsafe-enabled wireless device 202 does not need to communicate with a responding device 212 in implementing the failsafe procedure.

Although FIG. 2 illustrates one example of an operational environment in which a failsafe-enabled wireless device 202 may be implemented, various changes may be made to FIG. 2. For example, although the controller 204 may represent a control room of a process control system 100 as previously described, the controller 204 may also represent an intermediate receiver, a handheld receiver, a maintenance system, a safety system or any other suitable component or system. For a particular example, the failsafe-enabled wireless device 202 may represent a burglar alarm sensor, and the controller 204 may represent an alarm monitoring company. For this particular example, the responding device 212 (or the failsafe-enabled wireless device 202) may take action based on the signal 208 being lost due to a burglar disabling the wireless transmission capabilities of the device 202. Thus, the failsafe-enabled wireless device 202 may represent any suitable type of wireless device, and the responding device 212 may represent any suitable component that is capable of taking action when the wireless signal quality is lost or becomes poor.

FIG. 3 illustrates a method 300 for operating the failsafe-enabled wireless device 202 according to one embodiment of this disclosure. The embodiment of the method 300 is for illustration only. Other embodiments of the method 300 may be implemented without departing from the scope of this disclosure. In addition, while shown as a series of steps, the steps in the method 300 may overlap, occur in parallel, occur multiple times, or occur in a different order.

As shown in FIG. 3, a method 300 includes a failsafe control system 206 monitoring a signal quality of a wireless signal 208 between a failsafe-enabled wireless device 202 and a controller 204 at step 302. For example, the failsafe control system 206 may monitor the signal quality by comparing the signal quality to a predetermined threshold, by determining whether the signal quality has fallen by a specified percentage, or in any other suitable manner. If the signal quality of the signal 208 is not determined to be poor by the failsafe control system 206 at step 304, the failsafe control system 206 may continue to monitor the signal quality at step 302.

However, if the signal quality of the signal 208 is determined to be poor by the failsafe control system 206 at step 304, the failsafe control system 206 may determine whether or not hazard indicators have been detected at optional step 306. For example, for an embodiment in which the failsafe-enabled wireless device 202 is a temperature transmitter, the failsafe control system 206 may determine whether the temperature exceeds a predetermined threshold, has deviated from a last-reported temperature by a specified percentage and/or the like. These hazard indicators may be detected by the failsafe control system 206 and/or detected by other wireless devices 210 in communication with the failsafe-enabled wireless device 202.

If no hazard indicators are detected by the failsafe control system 206 at step 306, the failsafe control system 206 may continue to monitor the signal quality at step 302. However, if one or more hazard indicators are detected at step 306, the method continues to step 308. In addition, if the failsafe control system 206 does not consider hazard indicators but only the signal quality of the signal 208 in determining whether to initiate the failsafe procedure (in which case step 306 is omitted), the method continues to step 308 when the signal quality of the signal 208 is poor at step 304.

If the failsafe-enabled wireless device 202 is capable of control (at step 308), the failsafe control system 206 initiates the failsafe procedure by generating a failsafe control signal for the failsafe-enabled wireless device 202 at step 310. The failsafe-enabled wireless device 202 then implements the failsafe procedure at step 312. For example, the failsafe-enabled wireless device 202 may close a switch or valve or perform any other suitable function or functions in order to implement the failsafe procedure.

However, if the failsafe-enabled wireless device 202 is incapable of control (at step 308), the failsafe control system 206 initiates the failsafe procedure by generating a failsafe control signal for a responding device 212 at step 314 and sending the failsafe control signal to the responding device 212 at step 316. The responding device 212 may then implement the failsafe procedure by, for example, closing a switch or valve or by performing any other suitable function or functions in order to implement the failsafe procedure.

In some embodiments, various functions described above are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory.

It may be advantageous to set forth definitions of certain words and phrases used throughout this patent document. The term "couple" and its derivatives refer to any direct or indirect communication between two or more elements, whether or not those elements are in physical contact with one another. The terms "application" and "program" refer to one or more computer programs, software components, sets of instructions, procedures, functions, objects, classes, instances, related data, or a portion thereof adapted for implementation in a suitable computer code (including source code, object code, or executable code). The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The term "each" means every one of at least a subset of the identified items. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method comprising:

monitoring a signal quality for a wireless signal between a failsafe-enabled wireless device and a controller using a failsafe control system;

determining whether the signal quality is poor; and initiating a failsafe procedure when the signal quality is poor.

2. The method of claim 1, further comprising:

detecting at least one hazard indicator;

wherein initiating the failsafe procedure comprises initiating the failsafe procedure when both the signal quality is poor and the at least one hazard indicator is detected.

3. The method of claim 1, further comprising:

receiving hazard indicator information from at least one wireless device in communication with the failsafe-enabled wireless device;

wherein initiating the failsafe procedure comprises initiating the failsafe procedure when both the signal quality is poor and the hazard indicator information is received from the at least one wireless device.

4. The method of claim 1, wherein initiating the failsafe procedure comprises:

generating a failsafe control signal; and sending the failsafe control signal to a responding device.

5. The method of claim 1, wherein determining whether the signal quality is poor comprises comparing the signal quality to a specified threshold.

6. The method of claim 1, wherein determining whether the signal quality is poor comprises determining whether the signal quality has fallen by a specified percentage.

7. The method of claim 1, wherein initiating the failsafe procedure comprises:

generating a failsafe control signal for the failsafe-enabled wireless device; and implementing the failsafe procedure within the failsafe-enabled wireless device.

8. An apparatus comprising:

a failsafe control system operable to (i) monitor a signal quality for a wireless signal between a failsafe-enabled wireless device and a controller, (ii) determine whether the signal quality is poor, and (iii) initiate a failsafe procedure when the signal quality is poor.

9. The apparatus of claim 8, wherein the failsafe control system comprises a wired loop control.

10. The apparatus of claim 8, wherein:

the failsafe control system is further operable to detect at least one hazard indicator; and the failsafe control system is operable to initiate the failsafe procedure when both the signal quality is poor and the failsafe control system detects the at least one hazard indicator.

11. The apparatus of claim 8, wherein:

the failsafe control system is further operable to receive hazard indicator information from at least one wireless device in communication with the failsafe-enabled wireless device; and the failsafe control system is operable to initiate the failsafe procedure when both the signal quality is poor and the failsafe control system receives hazard indicator information from the at least one wireless device.

12. The apparatus of claim 8, wherein the failsafe control system is operable to initiate the failsafe procedure by generating a failsafe control signal and sending the failsafe control signal to a responding device.

13. The apparatus of claim 8, wherein the failsafe control system is operable to determine whether the signal quality is poor by comparing the signal quality to a specified threshold.

14. The apparatus of claim 8, wherein the failsafe control system is operable to determine whether the signal quality is poor by determining whether the signal quality has fallen by a specified percentage.

15. The apparatus of claim 8, wherein the failsafe control system is operable to initiate the failsafe procedure by generating a failsafe control signal that is configured to cause the failsafe-enabled wireless device to implement the failsafe procedure.

16. A tangible computer readable storage medium embodying a computer program, the computer program comprising computer readable program code for:

monitoring a signal quality for a wireless signal between a failsafe-enabled wireless device and a controller;

determining whether the signal quality is poor; and initiating a failsafe procedure when the signal quality is poor.

17. The computer readable storage medium of claim 16, wherein:

the computer program further comprises computer readable program code for detecting at least one hazard indicator; and the computer readable program code for initiating the failsafe procedure comprises computer readable program code for initiating the failsafe procedure when both the signal quality is poor and the at least one hazard indicator is detected.

18. The computer readable storage medium of claim 16, wherein:

the computer program further comprises computer readable program code for receiving hazard indicator information from at least one wireless device in communication with the failsafe-enabled wireless device; and the computer readable program code for initiating the failsafe procedure comprises computer readable program code for initiating the failsafe procedure when both the signal quality is poor and the hazard indicator information is received from the at least one wireless device.

19. The computer readable storage medium of claim 16, wherein the computer readable program code for initiating the failsafe procedure comprises computer readable program code for generating a failsafe control signal and sending the failsafe control signal to a responding device.

20. The computer readable storage medium of claim 16, wherein the computer readable program code for determining whether the signal quality is poor comprises computer readable program code for at least one of: (i) comparing the signal quality to a specified threshold and (ii) determining whether the signal quality has fallen by a specified percentage.

* * * * *